US009966669B2

(12) United States Patent
Dobric et al.

(10) Patent No.: US 9,966,669 B2
(45) Date of Patent: May 8, 2018

(54) PATCH ANTENNA ARRANGEMENT

(71) Applicant: KATHREIN-WERKE KG, Rosenheim (DE)

(72) Inventors: Nikola Dobric, München (DE); Alois Huber, Furstenzell (DE)

(73) Assignee: Kathrein-Werke KG, Rosenheim (DE)

( * ) Notice: Subject to any disclaimer, the term of this patent is extended or adjusted under 35 U.S.C. 154(b) by 59 days.

(21) Appl. No.: 14/368,191

(22) PCT Filed: Dec. 6, 2012

(86) PCT No.: PCT/EP2012/005037
§ 371 (c)(1),
(2) Date: Jun. 23, 2014

(87) PCT Pub. No.: WO2013/091785
PCT Pub. Date: Jun. 27, 2013

(65) Prior Publication Data

US 2014/0361952 A1 Dec. 11, 2014

(30) Foreign Application Priority Data

Dec. 22, 2011 (DE) ..... 10 2011 122 039

(51) Int. Cl.
*H01Q 21/00* (2006.01)
*H01Q 19/00* (2006.01)
(Continued)

(52) U.S. Cl.
CPC ..... *H01Q 21/00* (2013.01); *H01Q 1/3275* (2013.01); *H01Q 5/378* (2015.01); *H01Q 5/385* (2015.01);
(Continued)

(58) Field of Classification Search
CPC .. H01Q 9/0428; H01Q 9/0464; H01Q 9/0414; H01Q 9/0435; H01Q 1/3275;
(Continued)

(56) References Cited

U.S. PATENT DOCUMENTS 4,691,206 A * 9/1987 Shapter ..... H01Q 13/18 343/700 MS
6,118,406 A * 9/2000 Josypenko ..... H01Q 1/38 343/700 MS
(Continued)

FOREIGN PATENT DOCUMENTS

CN 101467304 A 6/2009
CN 101771198 A 7/2010
(Continued)

OTHER PUBLICATIONS

English translation of the International Preliminary Report on Patentability and Written Opinion of the International Searching Authority dated Jul. 3, 2014, issued in corresponding International Application No. PCT/EP2012/005037.
(Continued)

*Primary Examiner* — Dameon E Levi
*Assistant Examiner* — Ab Salam Alkassim, Jr.
(74) *Attorney, Agent, or Firm* — Nixon & Vanderhye P.C.

(57) ABSTRACT

An improved patch antenna arrangement includes a patch electrode and a frame patch electrode surrounding the patch electrode provided on a dielectric. A top patch is also provided. The top patch is arranged opposite the dielectric at a distance from the patch electrode surface and at a distance from the ring or frame patch electrode surface. The top patch has an extent in the longitudinal and transverse direction, such that the top patch covers both the patch electrode surface and the frame patch electrode surface at least in some sections.

36 Claims, 9 Drawing Sheets

(51) Int. Cl.

| | |
|---|---|
| ***H01Q 9/04*** | (2006.01) |
| ***H01Q 21/30*** | (2006.01) |
| ***H01Q 1/32*** | (2006.01) |
| ***H01Q 5/378*** | (2015.01) |
| ***H01Q 5/385*** | (2015.01) |

(52) U.S. Cl.
CPC ..... *H01Q 9/0414* (2013.01); *H01Q 9/0428* (2013.01); *H01Q 9/0435* (2013.01); *H01Q 9/0464* (2013.01); *H01Q 19/005* (2013.01); *H01Q 21/30* (2013.01)

(58) Field of Classification Search
CPC ..... H01Q 21/30; H01Q 21/00; H01Q 5/378; H01Q 5/385
USPC ..... 343/700 MS, 893
See application file for complete search history.

(56) References Cited

U.S. PATENT DOCUMENTS

| | | | | |
|---|---|---|---|---|
| 6,680,703 | B1 * | 1/2004 | McConnell | H01Q 9/0428 343/700 MS |
| 7,129,899 | B2 * | 10/2006 | Jecko | H01Q 9/0421 343/702 |
| 7,215,288 | B2 * | 5/2007 | Park | H01Q 9/0414 343/700 MS |
| 7,253,770 | B2 | 8/2007 | Yegin et al. | |
| 7,385,555 | B2 * | 6/2008 | Mahmoud | H01Q 1/28 343/700 MS |
| 7,405,700 | B2 | 7/2008 | Duzdar et al. | |
| 7,460,072 | B1 * | 12/2008 | Goldberger | H01Q 1/38 343/700 MS |
| 7,710,331 | B2 * | 5/2010 | Schillmeier | H01Q 9/0414 343/700 MS |
| 7,821,460 | B2 * | 10/2010 | Schillmeier | H01Q 9/0414 343/700 MS |
| 7,911,392 | B2 * | 3/2011 | Rao | H01Q 1/243 343/700 MS |
| 7,936,306 | B2 * | 5/2011 | Mierke | H01Q 21/28 343/700 MS |
| 7,994,999 | B2 * | 8/2011 | Maeda | H01Q 9/0407 343/700 MS |
| 9,478,869 | B1 * | 10/2016 | Zhu | H01Q 19/10 |
| 9,496,613 | B2 * | 11/2016 | Sawa | H01Q 9/0414 |
| 9,673,526 | B1 * | 6/2017 | Jensen | H01Q 9/0414 |
| 2003/0052825 | A1 | 3/2003 | Rao et al. | |
| 2003/0160728 | A1 * | 8/2003 | Fukushima | H01Q 1/242 343/702 |
| 2006/0273961 | A1 * | 12/2006 | Duzdar | H01Q 5/40 343/700 MS |
| 2008/0036665 | A1 * | 2/2008 | Schadler | H01Q 1/42 343/700 MS |
| 2008/0042915 | A1 * | 2/2008 | Schillmeier | H01Q 9/0414 343/745 |
| 2009/0058731 | A1 | 3/2009 | Geary et al. | |
| 2009/0140927 | A1 * | 6/2009 | Maeda | H01Q 9/0407 343/700 MS |
| 2010/0171679 | A1 * | 7/2010 | Ohshima | H01Q 9/0407 343/893 |
| 2010/0283684 | A1 * | 11/2010 | Rabinovich | H01Q 1/3275 343/700 MS |

FOREIGN PATENT DOCUMENTS

| | | | |
|---|---|---|---|
| DE | 10 2006 027694 | | 9/2007 |
| DE | 102006027694 | B3 * | 9/2007 |
| DE | 10 2006 038528 | | 11/2007 |
| DE | 10 2004 016158 | | 6/2010 |
| EP | 1 616 367 | | 1/2007 |
| EP | 1 657 784 | | 2/2010 |
| JP | 2006-121219 | | 5/2006 |
| JP | 2006121219 | A * | 5/2006 |
| KR | 2001-0079242 | A | 8/2001 |
| WO | 2007/144104 | A1 | 12/2007 |

OTHER PUBLICATIONS

International Search Report for PCT/EP2012/005037, dated Jun. 13, 2013.

Foreign-language Written Opinion of the International Searching Authority for PCT/EP2012/005037, dated Jun. 3, 2013.

* cited by examiner

F1
F2
F
x
y
7'
7
15a
15b
15c
15d
15e
15f
15g
15

PATCH ANTENNA ARRANGEMENT

This application is the U.S. national phase of International Application No. PCT/EP2012/005037, filed 6 Dec. 2012, designating the U.S. and claiming priority to DE Application No. 10 2011 122 039.2, filed 22 Dec. 2011, the entire contents of each of which are hereby incorporated by reference.

The invention relates to a patch antenna assembly according to the preamble of claim 1.

Patch antennas of the type in question are frequently also used as motor vehicle antennas. Motor vehicle antennas can have a fin-like construction, for example. They are often mounted on the vehicle body and more particularly in the roof region of a motor vehicle, just above the rear window. A plurality of individual antennas for the various services provided, i.e. antennas for receiving terrestrially broadcast radio programmes, GPS patch antennas, antennas for mobile communications, for transmitting and receiving mobile phone calls over the different frequency ranges, optionally also additional antenna assemblies for receiving radio programmes broadcast via satellite, such as SDARS programmes, etc., are located on a chassis under the cap of the antenna assembly. An antenna of this type is known from EP 1 616 367 B1, for example.

Accordingly, an antenna construction of this type requires a significant amount of installation space. Nevertheless, requirements are tending towards further miniaturising a corresponding antenna assembly in order for it to require less installation space.

Regarding the basic construction of a patch antenna, reference is also made inter alia to DE 10 2004 016 158 B4, which describes a conventional patch antenna comprising a ground plane, a substrate layer positioned thereon and a patch electrode provided on the upper side which can be covered with a further layer which forms a dielectric.

A multi-frequency flat-top antenna, by means of which circularly polarised electromagnetic waves can be received or transmitted, is known from U.S. Pat. No. 7,405,700 B2. This known antenna comprises a substrate (dielectric), in the centre of which a rectangular or square central patch of a patch antenna is provided.

A frame-shaped or annular second patch antenna surface extends around this patch antenna, the inner edge of which antenna surface extends with slight spacing from the outer edge surrounding the central patch antenna, whereby a spacing gap is thus formed between the central patch and the annular or frame-shaped patch antenna.

Owing to the specific configuration of bevels, in particular in the corner regions, it is intended to be ensured that the annular or frame-shaped patch antenna receives or transmits electromagnetic waves that are oppositely polarised compared with the centrally arranged patch antenna.

Aside from antennas of this type, other antenna types are also known in principle, for example from US 2009/0058731 A1 and US 2010/0283684 A1, in each of which what is known as a stacked patch antenna is provided, which comprises, in addition to a ground plane with spacing therefrom, a first radiating patch surface and, with further spacing, a second radiating patch surface again arranged above said first patch surface.

Furthermore, reference should also be made to U.S. Pat. No. 7,253,770 B2, one embodiment of which discloses a patch antenna comprising a ground plane, a dielectric positioned thereabove and a patch antenna assembly on the upper side of the dielectric. A patch surface supplied with power via a feed line is provided in the centre of the upper side of the dielectric, which surface is surrounded by an additional frame-shaped patch antenna at the same level. A spacing gap is formed between both patch antennas on the upper side of the dielectric. This patch antenna assembly is used to receive GPS and SDARS signals. In another embodiment, by way of contrast a conventional stacked antenna is disclosed, in which the two patch surfaces are arranged one above the other.

US 2003/0052825 A1 also describes an antenna assembly comprising an inner patch antenna which is surrounded, via an annular gap, by an annular patch antenna surrounding the inner patch antenna. In another embodiment, the construction is selected such that two inner, round patch antennas are arranged one above the other with vertical spacing, as are two annular patch antennas which surround the inner patch antennas and likewise are arranged one above the other with the same vertical spacing and are each separated from the inner patch antenna via an annular gap.

A category-defining patch antenna assembly is known from US 2010/0171679 A1. An inner patch antenna that is square in plan view is disclosed which is surrounded by a frame-shaped patch antenna under formation of a spacing gap between the two. Two attachment patch assemblies are provided thereabove which are likewise separated from each other by a spacing gap, a central attachment patch being arranged directly above the central patch which is supplied with power and is positioned therebelow, and the second frame-shaped attachment patch being positioned directly above the frame-shaped radiation surface positioned therebelow.

Against this background, the problem addressed by the present invention is that of providing an improved antenna assembly which allows for a patch antenna assembly using simple means and with only a small amount of installation space, by means of which assembly a right-circular or a left-circular electromagnetic wave can be transmitted or received.

The problem is solved according to the invention in accordance with the features specified in claim 1. Advantageous configurations of the invention are described in the dependent claims.

The antenna according to the invention is distinguished inter alia in that it is for example capable of receiving GPS signals, that is to say generally signals for geostationary position determination, while requiring a comparatively small installation space. For antennas of this type, patch antennas are usually used, and are also used within the context of the present invention.

However, the present patch antenna according to the invention also makes it possible to receive additional satellite signals, for example radio programmes broadcast in accordance with the SDARS or SIRIUSXM® standard, as is the case primarily in North America.

The solution according to the invention proceeds from a patch antenna assembly (for example for receiving GPS signals) in which a patch surface of the patch antenna assembly is surrounded by an additionally provided annular patch or frame patch under formation of a spacing gap. This annular or frame patch is used as an additional patch antenna, for example for receiving the above-mentioned SDARS or SIRIUSXM®-satellite signals.

In order to couple the annular or frame-shaped patch to the central patch (since the entire patch antenna assembly is for example only supplied with power via a central feed line), within the context of the invention, by contrast with the prior art, it is provided that both patch antenna assemblies are covered by a common passive attachment patch.

The attachment patch and the active radiation patch of the central patch antenna arranged therebelow form a plate capacitor, whereby capacitance is produced between the two patch surfaces. As a result, within the context of the invention, energy can be transferred from the central patch electrode to the annular patch or vice versa. In this case, the surface of the patch surfaces on one hand and the spacing therebetween on the other are significant for the capacitance. Regarding the annular or frame-shaped patch, in this respect the antenna is thus indirectly supplied with power.

The solution according to the invention is extremely advantageous compared with the category-defining prior art according to US 2010/0171679 A1 or U.S. Pat. No. 7,405,700 B2 since, in the above-mentioned category-defining prior art, the spacing gap between the central patch electrode and the annular or frame-shaped patch electrode surface surrounding the central patch electrode has to be extremely narrow, i.e. extremely low, in order to still ensure sufficient coupling. The attachment patch provided within the context of the invention makes possible a much improved coupling between the annular or frame-shaped patch electrode and the central patch electrode surface, with considerably fewer requirements in terms of tolerances. This ultimately leads to considerable cost advantages in terms of manufacturing, since even the smallest of deviations with respect to the gap do not lead, within the context of the antenna according to the invention, to the type of disadvantageous changes that are found in the prior art, in which even the slightest of changes to the optimum size of the gaps lead to a noticeable impairment of the transmitting or receiving quality of the antenna.

In a preferred manner, by geometrically selecting the central patch, that is to say the radiation surface of the central patch, it can be determined whether said patch is a left- or right-circularly radiating patch. In the case of an SDARS antenna, the central patch has to be set to be left-circulating. By shaping it accordingly, the annular patch can then be set such that it operates in a right-circularly radiating manner, in this case such that it is thus capable of receiving the SDARS or SIRIUSXM® signals, for example.

The setting such that the radiation surface of the centrally arranged patch is right-circulating, for example, can be brought about by the above-mentioned shaping of the radiation surface, for example in that two diametrically opposite corners of the preferably square patch surface comprise flat edges, and specifically in a known manner when accordingly positioning the antenna power supply.

Alternatively, it is also possible to supply the power via two power supply lines which are offset by 90°, whereby the determination with respect to left- or right-circularly polarised electromagnetic waves can take place in the case of a corresponding phase shift. A patch electrode surface which is round in principle and more particularly circular can thus be used as a central patch electrode. In this case, the annular patch may have an inner boundary edge, which is also approximately circular and surrounds the at least approximately disc-shaped or circular patch electrode surface with a small spacing gap. The outer boundary edge of the outer annular patch may for example in turn be at least approximately square. In this case, a wide variety of variants and modifications are possible.

In a modification to the above-mentioned inventive principle, it is also possible to determine the generation of the polarisation in the annular patch in a different way. In this modified variant, within the context of the invention, it is provided that for example a right-circular polarisation can be generated in the annular patch using a galvanic through-connection between the attachment patch and the earth. In this case, this through-connection is not connected to the radiation patch of the central patch antenna. Determining the direction of circulation also depends again on the position of the through-connection, which is offset by 90° from the feed line (in a central plan view of the patch antenna assembly).

Finally, it is also noted that the attachment patch not only has to consist of an essentially parallel electromagnetic surface or layer with spacing above the central patch electrode and the annular or frame-shaped patch electrode surrounding the central patch electrode, but said attachment patch can also comprise recesses, for example, or can be provided with bends on its peripheral edge, at least one part of which extends away from the substrate positioned therebelow or a corresponding part of which extends towards the substrate, etc. In this respect, only a portion of the patch, that is to say a patch surface portion in the region of the central patch electrode and the annular or frame-shaped patch electrode, of the attachment patch has to be arranged in a plane above said patch surfaces.

Finally, it is also possible for the attachment patch to be galvanically connected to the annular or frame-shaped electrode. In this case, there would only still be a capacitive coupling between the central patch electrode and the attachment patch. In reverse, it is also possible for the attachment patch to be galvanically connected to the central patch electrode or to start therefrom, and for example is only provided and configured with one peripheral annular or frame-shaped shoulder above the annular or frame-shaped patch electrode with spacing therefrom, under formation of a capacitive coupling. In this case, there would only be a coupling between the attachment patch and the annular or frame-shaped electrode.

The patch antenna assembly according to the invention is mainly distinguished in that it is extremely advantageous in terms of production and manufacturing compared with conventional, known patch antenna assemblies.

Further advantages, details and features of the invention emerge from the embodiments set out in the following. In the drawings.

Figure 11:
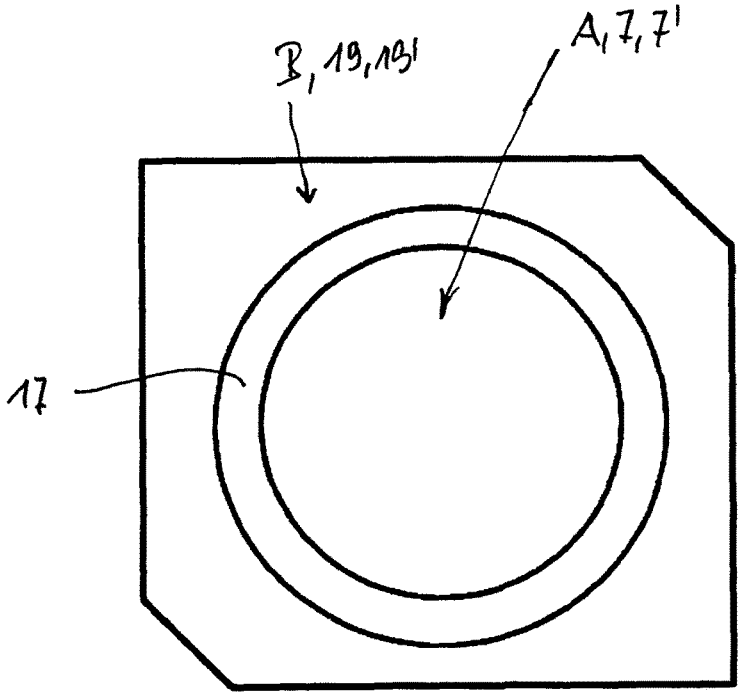
Figure 12A:
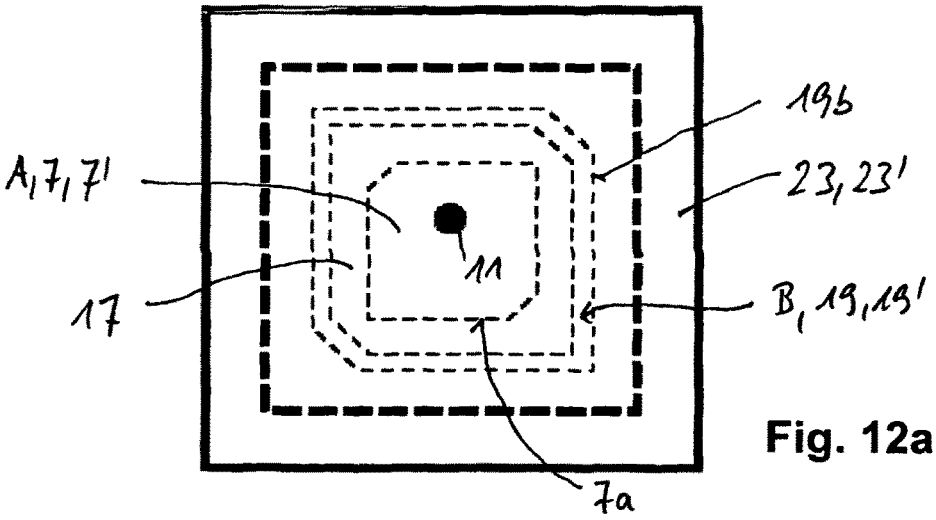
Figure 12B:
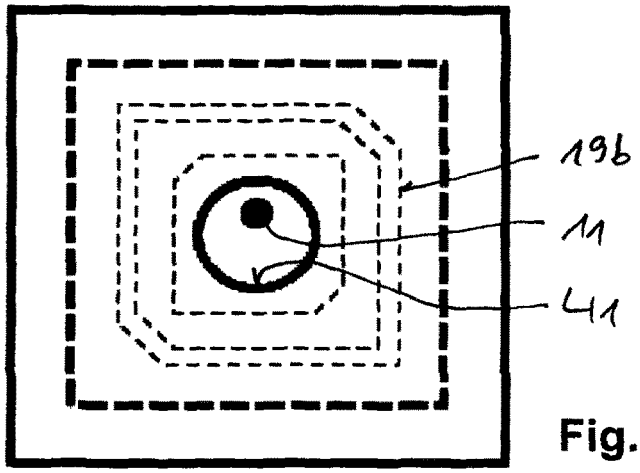
Figure 12C:
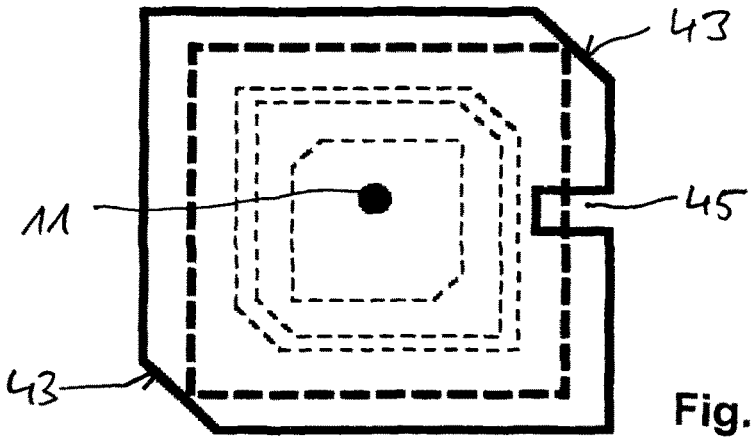
Figure 13A:
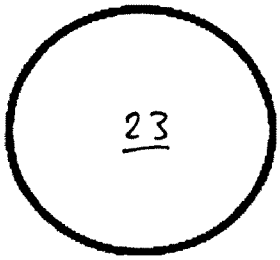
Figure 13B:
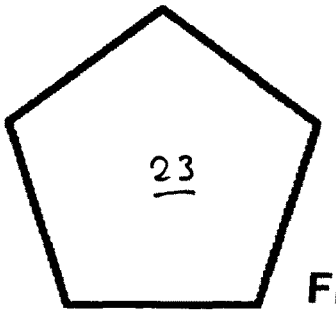
Figure 17:
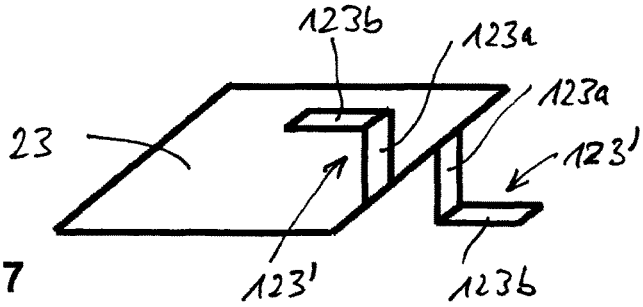
Figure 18A:
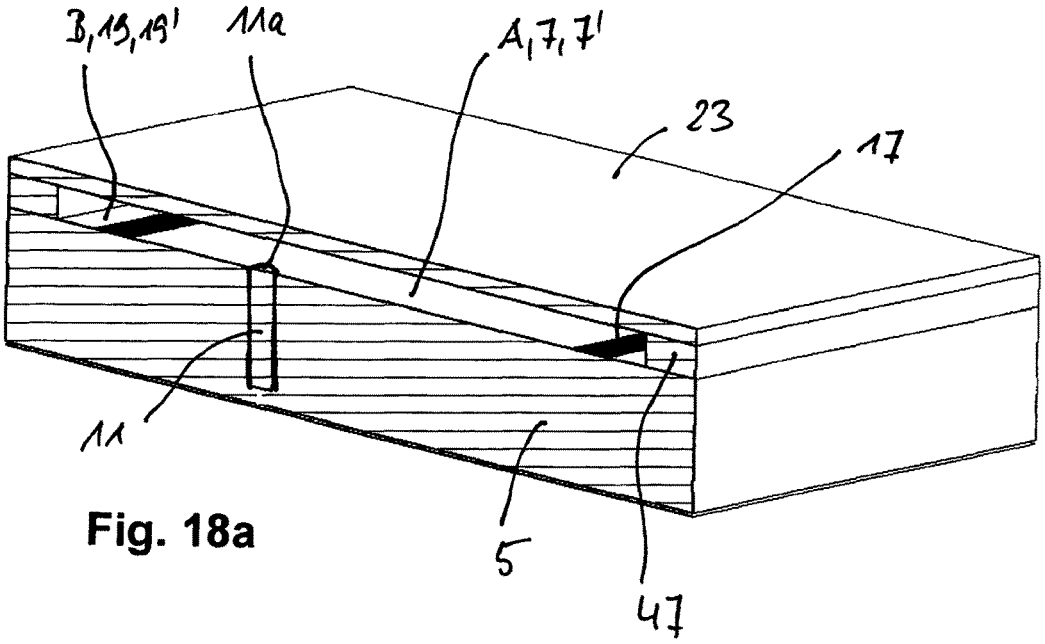
Figure 18B:
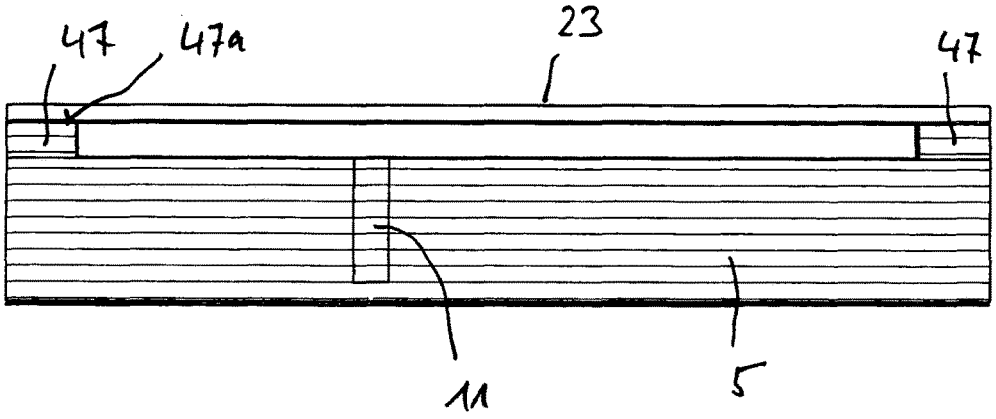

FIGS. 8*a* to 8*d* are four schematic plan views of four embodiments of a patch electrode;

FIGS. 9*a* to 9*d* are four schematic plan views of an essentially square patch electrode comprising projections, recesses or an elongate slot;

FIGS. 10*a* to 10*d* are schematic plan views of four further embodiments of a modified patch electrode also comprising projections or recesses;

FIG. 11 is a schematic plan view of a multi-patch antenna assembly comprising a circular or disc-shaped central patch electrode and an annular or frame patch electrode surrounding said central patch electrode and comprising an inner circular and outer square boundary edge;

FIGS. 12*a* to 12*c* are schematic plan views of three modified embodiments illustrating that the attachment patch projects beyond the annular patch and may be provided with inner recesses or with recesses extending inwards from the peripheral edge;

FIGS. 13*a* and 13*b* are schematic plan views of two modified embodiments illustrating that the attachment patch can have different geometric shapes;

FIGS. 14*a* to 16*b* are different views illustrating that the attachment patch can also be provided with various peripheral or partly peripheral edge and flank portions, one part of which extends away from the substrate or towards the substrate, can be provided with bends, etc.;

FIG. 17 is a schematic perspective view illustrating that the attachment patch can also be provided with angular shoulders provided in the peripheral direction in specific regions;

FIG. 18*a* is a schematic spatial view through a modified embodiment using a dielectric between the attachment patch and the patch electrode positioned therebelow;

FIG. 18*b* is a schematic cross section through the embodiment shown in FIG. 18*a;*

Figure 19A:
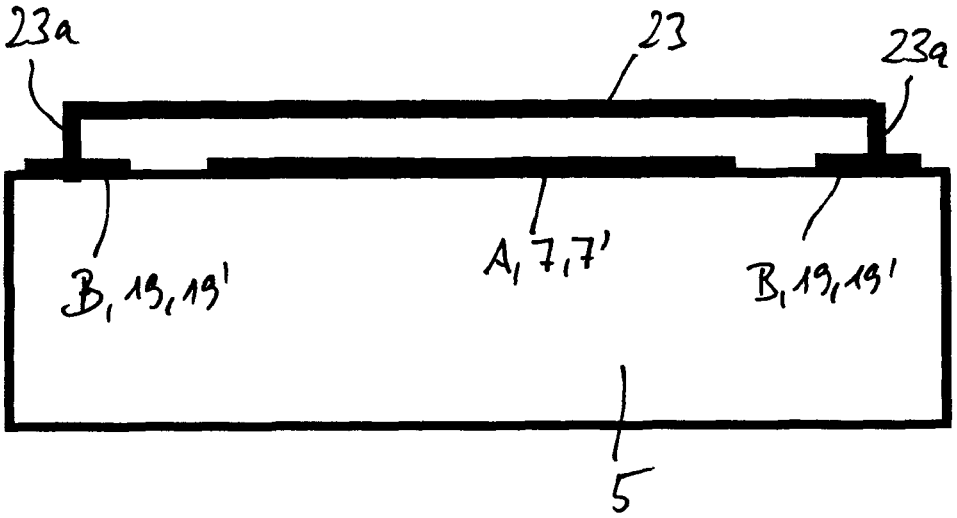
Figure 19B:
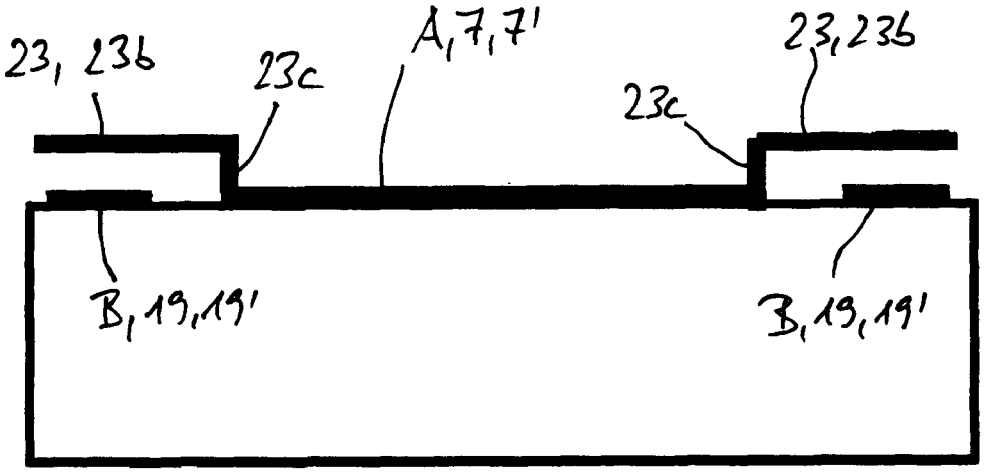

FIGS. 19*a* and 19*b* are two schematic cross sections in which the attachment patch is galvanically connected either to the annular or frame-shaped patch or to the central patch electrode, so that only a capacitive coupling to the central patch electrode or to the annular or frame-shaped patch electrode is still provided.

Figure 1:
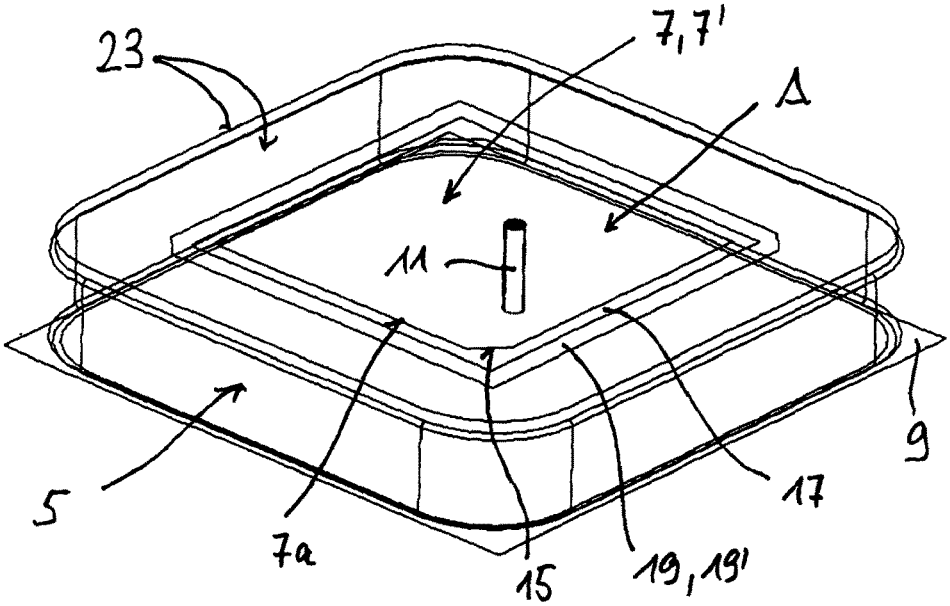
FIG. 1 is schematic perspective view of a first embodiment according to the invention of a patch antenna assembly.
Figure 2:
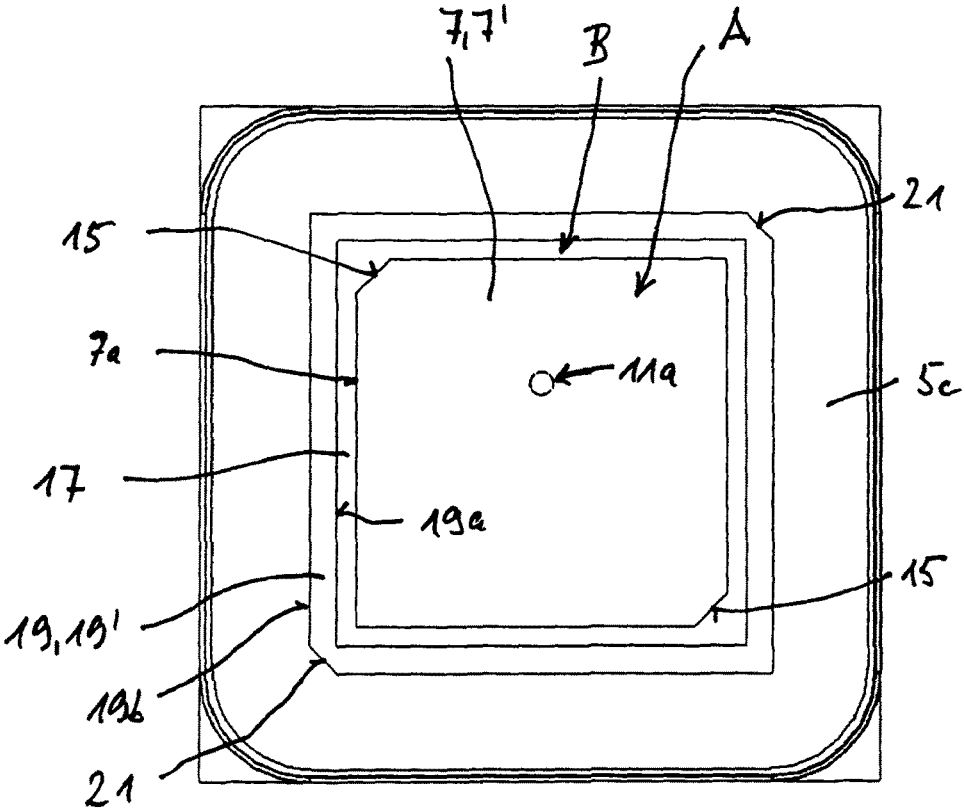
FIG. 2 is a schematic plan view, with the omission of an uppermost attachment patch.
Figure 3:
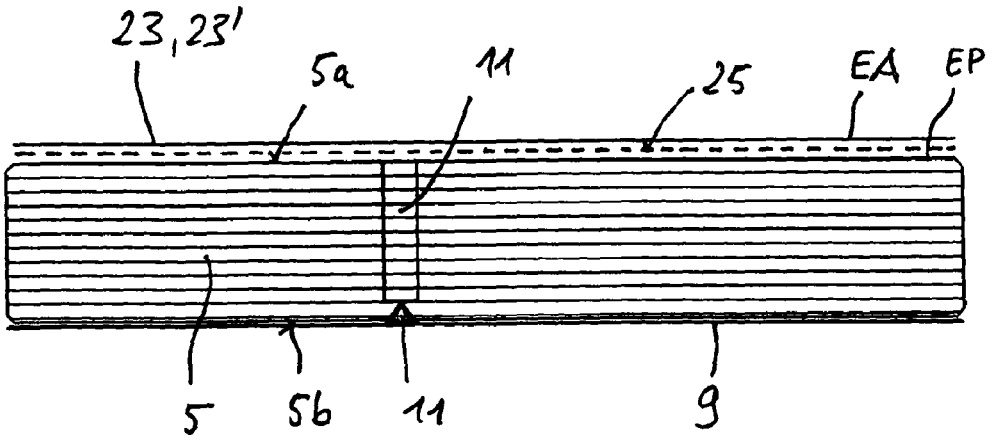
FIG. 3 is a vertical cross section through the patch surfaces and through the feed line.

FIGS. 1 to 3 show a first patch antenna assembly according to the invention. It can be seen from said figures that the patch antenna assembly comprises a first patch antenna A which has a metallised or metallic surface on a substrate or dielectric 5 on the upper side 5*a* of the dielectric 5, whereby the active patch surface 7' of a patch radiator 7 (for transmitting or receiving), that is to say the patch surface 7 that is supplied with power, is formed.

On the underside 5*b* of the dielectric 5, which is parallel to the upper side 5*a*, a ground plane 9 is provided as an antenna counterpoise.

A feed line 11 is provided through a hole 5*a* in the dielectric 5 which extends transverse and more particularly perpendicular to the upper side and underside 5*a*, 5*b* of the dielectric 5, which feed line extends from the underside of the substrate 5 as far as the active patch surface 7, which is also referred to as a patch electrode 7 in the following, and via which the patch electrode 7 is powered.

From the plan view in FIG. 2, it can be seen that, in the embodiment shown, the active patch surface 7 itself is rectangular and more particularly square, a flat edge 15 being made at two opposite corners 13, at which points the metallised patch surface 7' is thus removed. Together with the accordingly positioned feed line 11 which is connected to the patch electrode 7 at the feed-in point 11*a*, it is thus determined whether the patch antenna A thus formed is right- or left-circulating. In the present case, the assembly is such that the patch radiator 7 is left-circulating, that is to say has a left-circulating resonance, preferably at a frequency of 2.32 GHz, whereby the patch antenna A formed in this way is rendered capable of receiving the satellite programmes broadcast via the SDARS standard in accordance with the SDARS or SIRIUSXM® standard, that is to say of receiving corresponding radio programmes broadcast via satellites, as is the case primarily in North America.

The outer periphery 7*a* of the patch electrode 7 is surrounded by an annular patch 19 comprising an annular or frame-shaped patch surface 19' with relatively low spacing 17, whereby a second patch antenna B is formed.

In the embodiment shown, the annular patch 19 is in principle formed as a rectangular or square frame, which is also rectangular adjacent to the flat edge 15 (bevel) in the patch electrode 7, that is to say with respect to its inner boundary line 19*a*, which comes to rest adjacent to the peripheral boundary edge 7*a* of the inner patch electrode surface 7' with the above-mentioned preferably low spacing 17. The opposite boundary edge 19*b*, pointing outwards, of the annular or frame patch 19 is in principle also at least approximately rectangular or square, and here comprises corresponding flat edges 21 at two opposite corners 19*c*, at which surfaces a corresponding material of the surface, which is metallised or consists of a metal sheet, of the patch antenna B is removed.

The annular or frame patch 19 comprising an annular or frame-shaped annular-patch electrode surface 19' is formed as a planar metallised surface in the same way as the patch electrode 7 and, in the embodiment shown, is positioned on the same surface or upper side 5*a* of the dielectric 5, such that the annular patch electrode 19 of the patch antenna B and the patch electrode 7 of the first patch antenna A are in a common plane EP.

What is known as an attachment patch 23 comprising an attachment patch surface 23' is provided with low spacing above said plane EP as a third patch, which patch, in the embodiment shown, is also formed as a planar metallised surface or layer and comprises at least one corresponding surface with low spacing D adjacent to the plane EP.

By interposing a layer 25 that is adhesive on both sides, that is to say in the form of an insulator or dielectric, said attachment patch 23 can generate the galvanic separation between the patch electrode 7 and the annular patch electrode 19 and the adjacent attachment patch 23 extending parallel thereto.

The above-mentioned ground plane or the patch surfaces 7' or the annular or frame patch 19 as well as the attachment patch 23 can for example consist of an accordingly suitable metal layer, for example from a metal sheet or a film. The other layers can be bonded to the dielectric, that is to say to the substrate 5. The attachment patch 23 can for example be bonded to the upper side of the patch electrode 7 and of the annular patch 19 and to the remaining portions on the upper side 5*a* of the substrate 5 by means of a film that is adhesive on both sides.

As can also be seen from the drawings, the total longitudinal and transverse extension of the entire patch antenna assembly is considerably greater than the maximum longitudinal and transverse extension of the frame or annular patch antenna B on the upper side 5*a* of the dielectric. In this case, FIG. 1 is a perspective view of the entire patch antenna assembly, and FIG. 2 is a plan view of the first and second patch antennas A, B, with the omission of the attachment patch and an adhesive film 25 that may be used for attaching the attachment patch.

FIG. 3 is a cross section through the patch antenna assembly and through the feed line 11.

In terms of its dimensions, the entire assembly can be selected such that the dielectric or substrate 5 projects beyond the frame-shaped or annular patch electrode 19 in a longitudinal and transverse direction on each side by at least 10% and preferably more than 15%, more particularly more than 20%, and less than 50%, more particularly less than 40% and 30% and 25% respectively, of the maximum longitudinal and/or transverse extension length of the frame-shaped or annular patch electrode 19.

The corner regions of the dielectric body 5 are rounded; however this is not compulsory. Any suitable dielectric is possible in principle as the dielectric, for example ceramic.

Owing to this construction, the patch electrode 7 is supplied with power at the feed-in point 11*a* by means of a galvanic power supply, although by contrast there may instead be a capacitive power supply and excitation.

The above-mentioned position of the antenna power supply and the bevel or flat edge 21 formed at the opposite corners determine the polarisation of the emitted electromagnetic field. In the case shown, the active patch electrode 7, as mentioned, is left-circularly polarised, more particularly for SDARS or SIRIUSXM® services.

In order to cause excitation on the annular patch electrode 19 of the second patch antenna B, the above-mentioned metallic attachment in the form of the attachment patch 23 (passive patch antenna assembly) is provided, which can be implemented as a bonded metal sheet or a film.

The patch electrode 7 and the attachment patch 23 thus form a plate capacitor, whereby the energy from the patch electrode 7 can be transferred to the annular patch electrode 19 via the attachment patch 23.

In this case, the surface of the patch electrode 7, of the attachment patch 23 and the surface of the annular patch 19 and the spacing between the plane EP and the plane EA for the attachment patch assembly 23 determine the capacitance of the above-mentioned plate capacitor. The polarisation of the electromagnetic field is determined from the respective bevel, that is to say the arrangement of the bevel or flat edge 15 on the central patch electrode 7 or of the bevel or flat edge 21 on the annular or frame patch 19 of the second patch antenna assembly B.

By means of the outer bevels or flat edges 21, offset by 90° from one another, on the annular patch electrode 19, which is offset by 90° from the bevel or flat edge 15 on the patch electrode 7 which is positioned within the frame-shaped annular patch electrode 19, it is ensured that the annular patch electrode 21 is circularly polarised in the reverse direction from the inner patch electrode, in this case is thus right-circularly polarised. Accordingly, the annular patch electrode 21 is now suitable for corresponding positioning data from a satellite-based system, such as the GPS positioning system.

By means of the overall construction, a very compact and very small multi-band patch antenna assembly is produced which can operate in two different frequency ranges, namely for example for receiving GPS signals and SDARS programmes, which are each broadcast by a satellite.

Figure 4:
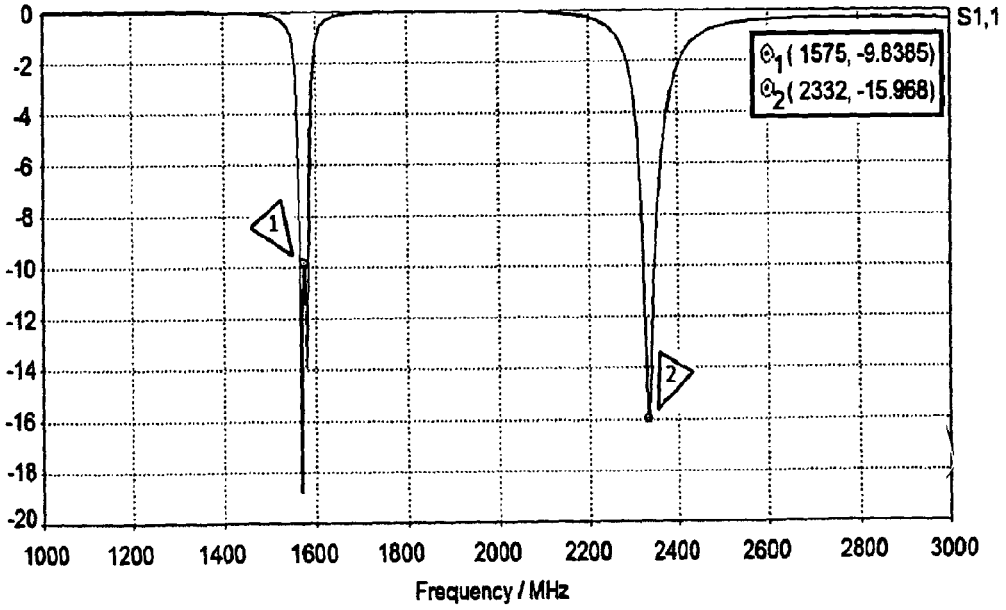
FIG. 4 shows the course of the resonance frequency for the patch antenna assembly.

With reference to FIG. 4, in this case for example the resonance frequency for the central patch antenna A and for the annular or frame patch antenna B is plotted, for example for the GPS antenna, a resonance frequency of 1.575 GHz plotted at "1" and, for the SDARS antenna, a resonance frequency (centre frequency) of 2.332 GHz (that is to say in a range of 2,320 to 2,345 MHz) plotted at "2" being shown at the points marked 1 and 2 respectively in the graph in FIG. 4.

The dimensions of the above-mentioned multi-band patch antenna may of course vary. For example, the patch antenna may have a longitudinal and transverse extension of preferably between 20 mm and 40 mm, more particularly around 30 mm, with respect to the substrate. The substrate height may vary for example between 2 mm and 6 mm, more particularly between 3 mm and 5 mm, preferably around 4 mm.

The central patch itself, that is to say the patch electrode surface 7', may be between 15 mm to 30 mm in the longitudinal and transverse directions, more particularly between 18 mm and 25 mm.

The ring connected thereto may have outer dimensions that are for example around 50% greater than the outer dimensions of the central patch electrode 7 in the longitudinal and transverse directions. Such values may for example vary according to the size of the inner patch electrode, more particularly the inner boundary edge of the annular patch, and may be between 20 mm and 30 mm, more particularly around 25 mm, whereas the outer boundary edge may be between preferably 25 mm and 35 mm, more particularly around 30 mm, in the longitudinal and transverse directions. The arrangement is generally such that the spacing gap 17 between the central patch electrode 7 and the annular or frame patch 19 varies between preferably 0.5 mm and 4 mm, more particularly between 1 mm and 3 mm, and preferably between 1.5 mm and 2.5 mm, for example being around 2 mm.

The attachment electrode 23 should preferably be dimensioned such that it reaches at least as far as the outer boundary edge 19*b* of the annular or frame patch 19 of the second patch antenna 7. Preferably, however, the longitudinal and transverse extension is greater. In the embodiment shown, the attachment patch 23 is dimensioned such that, in the longitudinal and transverse directions, it more or less corresponds to the dimensions in the longitudinal and transverse directions of the substrate, that is to say the dielectric 5. Nevertheless, the attachment patch 23 could also project beyond the substrate. Finally, it is noted that the substrate 5 may be made of any material. A substrate having an $\in_r$ that is for example between 2 and 30, more particularly between 5 and 25, has proven advantageous. In the embodiment shown, the attachment patch 23 also overlaps with a surface side region 5*c* of the dielectric, which is not overlapped by the patch antenna A or by the frame patch antenna B.

In the following, reference is made to a modified embodiment according to FIGS. 5 to 7, which is similar in principle to the construction according to the first embodiment.

Figure 5:
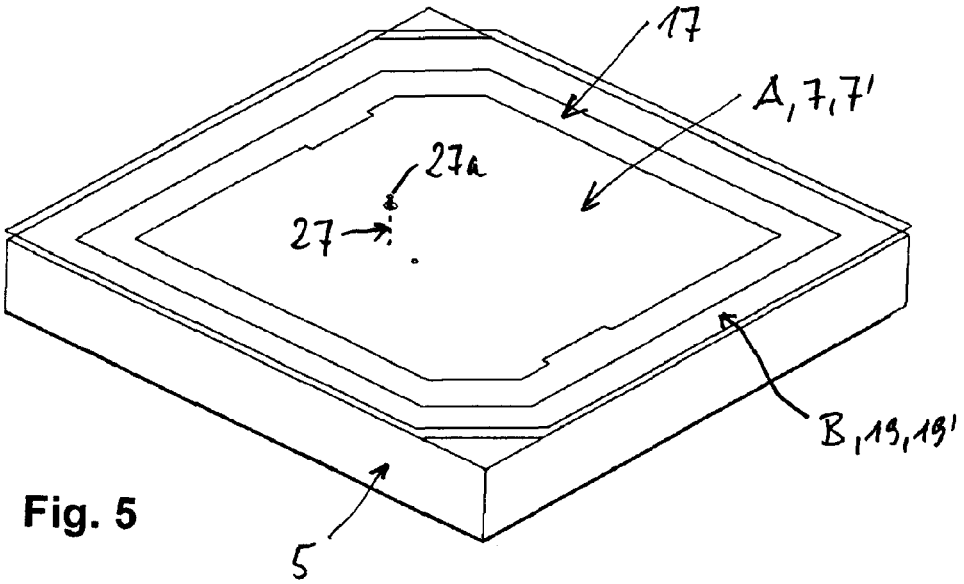
FIG. 5 is a corresponding view of a modified embodiment in schematic plan view of the upper attachment patch.
Figure 6:
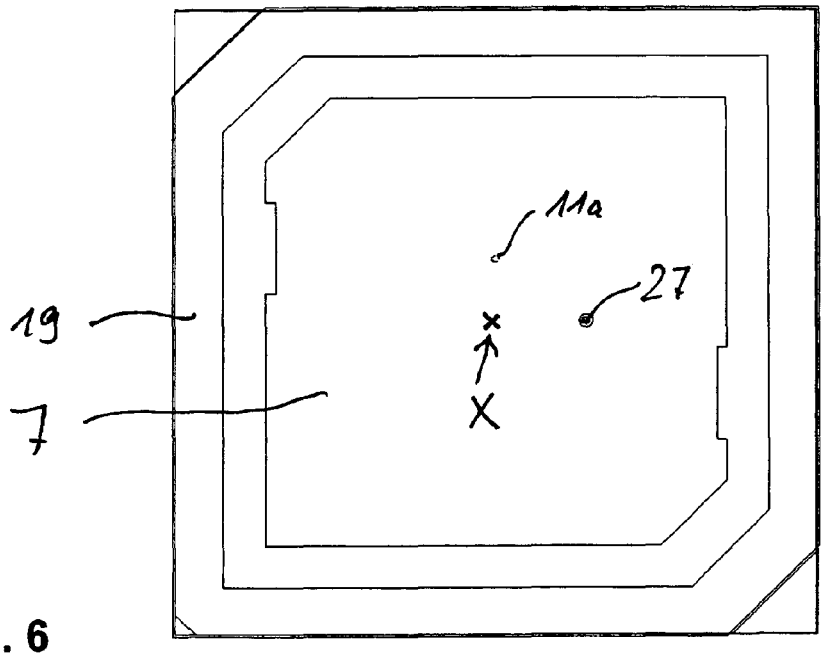
FIG. 6 is a corresponding plan view of the patch antenna assembly, with the omission of the uppermost attachment patch.
Figure 7:
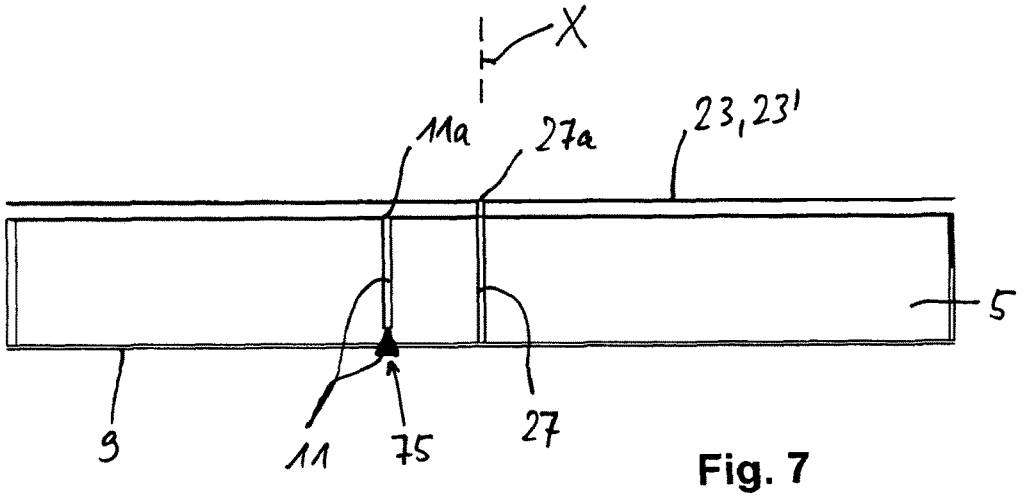
FIG. 7 is a cross section perpendicular to the patch surfaces and in a plane which extends through both the feed line for the patch electrode and the through-connection between the ground plane and the attachment patch.

A difference from the above-mentioned embodiment in the embodiment according to FIGS. 5 to 7 is that the generation of the polarisation in the annular patch electrode 19 is determined in a different way.

In this version, a galvanic through-connection is also provided, for example in the form of a line arrangement 27 which brings about a galvanic connection between the ground plane 9 (antenna counterpoise surface) and the attachment patch 23. This through-connection or line connection 27 is, however, not electrically (galvanically) connected to the patch electrode 7 itself but instead to the attachment patch 23 at 27*a*.

As can be seen from the plan view in FIG. 6, the position and arrangement of the through-connection 27 preferably also extend perpendicular to the upper side and underside 5*a*, 5*b* of the dielectric 5 and accordingly perpendicular to the patch electrode 7, the annular patch electrode 19 and the attachment patch surface 23. In accordance with this arrangement, the feed-in point 27*a* of the through-connection 27 is namely offset by 90° from the feed line 11 about the central axis X, the central axis X also extending perpendicular to the above-mentioned electrode surfaces and thus preferably parallel to the feed line 11.

Accordingly, in this embodiment, the flat edges or bevels 21 that are provided at the outer corners 19*b* so as to be offset by 180° from one another may be arranged and provided in the same adjacent corner region, in which the flat edges of the bevels of the inner patch electrode 7 come to rest.

Instead of the above-mentioned feed points 73*a*, 73*b* that are offset by 90° about the central axis, another phase shift can also be provided for the feed points, in particular if the phase shifter lines are adapted for a corresponding phase shift. In this respect, reference is made to measures and solutions that are known in principle.

The above-mentioned embodiments thus include variants in which the patch antenna assembly can receive and/or transmit oppositely circularly polarised electromagnetic waves using a central patch and an annular or frame patch surrounding the central patch. In this case, during transmission, power is preferably supplied via a single feed line, via which the power is supplied over the patch surface 7' of the patch antenna A. The annular or frame patch is supplied with power via the attachment patch 23 (by capacitive coupling) and/or by a separate power supply of the annular or frame-shaped patch 19, preferably via phase shifter lines. If electromagnetic waves are received, they are supplied to the two mutually offset frequency bands, preferably via the common feed line 11 of downstream electronics. In the case of the latter embodiment, the received signals are supplied from the annular or frame-shaped patch 19 via the capacitive coupling of the attachment patch to the central patch electrode 7, and from there via the feed line 11 and a feed point 75, provided at the lower end of the feed line 11, for downstream electronics. In transmission operation, the power is supplied in the reverse manner. The central patch 7 and the annular or frame-shaped patch (annular patch electrode) 19 are preferably at least substantially coplanar and concentric with a central axis X which passes perpendicularly through the substrate or the upper side or underside and/or the plane of the patch surface 7.

With reference to the above-mentioned embodiments, a variant without beam forming has been described according to FIGS. 1 to 4, and a variant with beam forming has been described according to FIGS. 5 to 7.

In the first variant according to FIGS. 1 to 4, the patch electrode 7 is, as mentioned, excited by means of a galvanic power supply (feed line 11), it also being possible for the power to be supplied capacitively. When receiving electromagnetic waves, the received signal is passed from the patch electrode 7 to the feed line 11 via this means. The position of the antenna power supply and the phase determine the polarisation of the emitted or received electromagnetic field. In the embodiment mentioned, the patch electrode 7 is left-circularly polarised (SIRIUSXM® services). In order to excite the annular or frame electrode 19, the above-mentioned metallic attachment in the form of the attachment patch 23 is required, which can preferably be implemented as a bonded metal sheet or as a film.

The central patch, that is to say the patch electrode 7 and the attachment electrode 23, form a plate capacitor, whereby energy can be transmitted from the patch surface (patch electrode) 7 to the ring in the case of transmitting, or in reverse in the case of receiving. The capacitance is determined by the surface and the spacing. The polarisation can be determined by the phase of the annular or frame-shaped patch electrode 19. In the embodiments mentioned, the annular or frame-shaped patch electrode 19 is right-circularly polarised (for example for GPS services).

In the second variant according to FIGS. 5 to 7, an operating principle based on the above-mentioned embodiments is used in principle. However, a difference from the embodiments according to FIGS. 1 to 4 is the generation of the polarisation in the annular or frame-shaped patch 19. In the variant according to FIGS. 5 to 7, a right-circular polarisation is generated, specifically using a galvanic through-connection between the attachment patch 23 and the earth 9, which is not connected to the patch surface 7'. The position of the through-connection 27 is a decisive factor in this case, since the through-connection 27 should be offset by 90°, or offset substantially by 90°, from the feed line 11. In addition, the through-connection 27 brings about beam forming, whereby the gain lobe is pivoted by a few degrees.

The following FIGS. 8*a* to 10*d* show in a schematic plan view how the patch electrode 7 positioned within the annular patch electrode 19 can be shaped and configured. The examples show not only flat edges on the opposite corner regions, but also preferably angular recesses 15*a*, longitudinal recesses on the opposite side strips, rectangular projecting tongues or lugs on a longitudinal side and thus on a boundary edge of the patch electrode surface 7 or diagonally projecting lugs in the corner regions. Corresponding recesses and elongate-slot recesses, which extend for example perpendicular to two opposite lateral boundaries or in a diagonal direction of the preferably square patch electrode surface 7, are also possible.

Figures 8A, 8B, 8C, 8D, 9A, 9B, 9C, 9D, 10A, 10B, 10C, 10D:
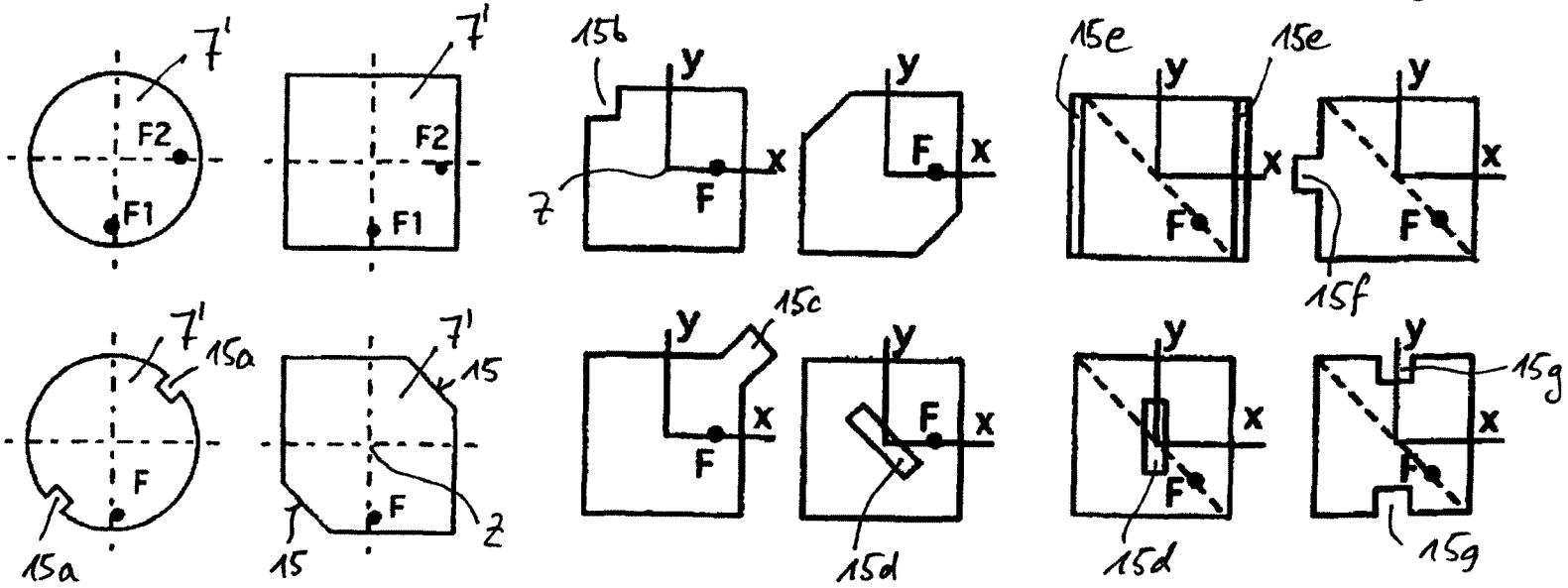

In addition, an X axis and a Y axis are each marked perpendicular to each other in the plane EP in which the patch electrode surface 7', 19' is located. FIG. 8*a*, for example, is a plan view of a patch electrode 7, which is circular or disc-shaped in principle, of the first patch antenna A, in which two feed-in points F1 and F2, mutually offset by 90°, are marked, by means of which power can be supplied in a manner mutually offset by 90°, whereby a circularly polarised electromagnetic wave is generated.

FIG. 8*b* shows a corresponding example of a configuration, which is square in plan view, of the patch electrode 7, comprising two feed-in points F1 and F2, that is to say differing from the previous embodiments by two generally mutually parallel feed lines 11 which are galvanically or capacitively connected to the patch electrode 7 at the respective feed-in points. The second feed line is supplied with power in a similar manner to the first feed line in the above-mentioned embodiment.

The variants according to FIGS. 8*c* and 8*d* describe a corresponding embodiment in which the respective patch electrodes 7 are only supplied with power via one feed line 11, at the feed-in point F in the selected plan view according to FIGS. 8*c* and 8*d*, the feed-in point F being turned in this case by 45°, specifically turned by 45° relative to the line connecting the recesses 15*a* or flat edges 15 opposite each other at 180°.

Accordingly, in this respect reference is also made to a central point Z in this embodiment and the next embodiments, from which point the direction towards the projections or flat edges on the patch electrode 7 is determined, and the direction deviating therefrom by 45°, which leads to the relevant feed-in point F, is determined.

Corresponding variants are for example also shown in FIGS. 9*a* to 9*b*, which all only operate with one feed line, which is electrically connected galvanically or capacitively to the central patch electrode 7 at a feed point F.

In the variant according to FIG. 9*a*, a square recess 15*b* is provided in the corner region instead of a diagonal flat edge.

In the variant according to FIG. 9*b*, a tongue-shaped or rectangular extension 15*c* is provided in the corner region, that is to say on a corner.

FIG. 9*c* shows a slot-shaped and more particularly rectangular recess 15*d* which is arranged in the patch electrode surface 7' over part of the length extending in the diagonal direction.

In the variant according to FIG. 10*a*, a strip-shaped extension 15*e* is provided opposite on the longitudinal edge of the rectangular or square patch electrode, whereby determination also takes place in the polarisation direction, at the same time taking into account the positioning of the one feed line, which in turn is galvanically or capacitively connected to the patch electrode 7 at the feed-in point F.

In the variant according to FIG. 10*b*, an extension 15*f* which projects in a tongue-shaped manner or as a rectangle is provided on a longitudinal edge and extends only over part of the length of the longitudinal edge of the patch electrode 7.

In the variant according to FIG. 10*c*, a slot-shaped recess 15*d* is again provided which in this case, however, is not oriented diagonally but rather perpendicularly or parallel to two opposite, parallel boundary edges, respectively, of the rectangular or square patch antenna assembly.

The variant according to FIG. 10*d* shows an example in which an inwardly pointing, tongue-shaped or rectangular recess 15*g* is provided on two opposite boundary edges, which determines the polarisation direction of the central patch electrode 7 together with the one feed line.

FIG. 11 shows a modified embodiment of a multi-patch antenna assembly in plan view, which embodiment specifically has a patch antenna A which is circular or disc-shaped in principle and can be designed as in the variant according to FIG. 8*a* or 8*c*.

Furthermore, the annular or frame patch antenna B surrounding the patch electrode 7 is marked in this embodiment, and has a likewise circular portion on the inside and a boundary line that is rectangular or, in principle, square on the outside, on which line likewise corresponding recesses or bevels are formed in order to generate an electromagnetic wave which circulates opposite to the central patch electrode 7.

In addition to the embodiment according to FIG. 8*b*, FIG. 11 schematically shows how the patch electrode 7 and the annular electrode 19 surrounding it can be formed below the attachment patch 23. In this variant, using a more or less circular or disc-shaped patch electrode 7, a narrow, annular gap 17 is preferably formed between the central patch electrode 7 and the annular electrode 19, which thus has a circular boundary edge 19*a* on the inside. By contrast, the outer boundary edge 19*b* can be more or less rectangular or square, corresponding flat edges or bevels 21 being provided so as to be offset by 180° for determining the oppositely circularly polarised wave.

FIGS. 12*a* to 12*c* show in plan view how the attachment patch 23, that is to say the attachment patch surface 23', can be designed and/or dimensioned. FIG. 12*a* shows that the attachment patch 23, that is to say the attachment patch surface 23', can protrude, that is to say project, laterally, that is to say laterally both in the longitudinal and transverse directions in plan view, beyond the outline of the annular or frame-shaped patch 19 positioned therebelow. It is preferably provided that the longitudinal and transverse directions of the attachment patch 23' correspond at least to the maximum longitudinal and transverse extension of the annular patch electrode 19, that is to say the annular patch electrode surface 19', positioned therebelow.

FIG. 12*b* schematically shows that the attachment patch surface 23' can also be perforated. This embodiment shows a central hole (in the present example a circular hole) 41 that is preferably in the centre of the attachment patch 23. However, more than just one hole can be provided in the attachment patch, which holes are formed in different positions. The shape and size of these holes can vary.

FIG. 12*c* schematically shows in plan view that, in addition, bevels 43 also formed in the corner regions in the attachment patch electrode 23, slots 45 extending inwards from the lateral boundaries or also curved recesses, which project so far inwards that even the annular or frame patch 19 positioned therebelow or at least a portion thereof is visible, can be provided.

FIGS. 13*a* and 13*b* show in schematic plan view that the shape of the attachment patch 23 is not necessarily limited to rectangular or square structures, but rather that a circular or polygonal structure can also be provided, preferably in the manner of a regular polygon, as can be seen from the schematic plan view in FIG. 13*b*.

Figure 14A:
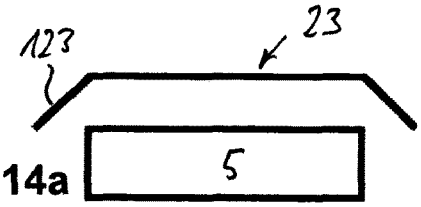
Figure 14B:
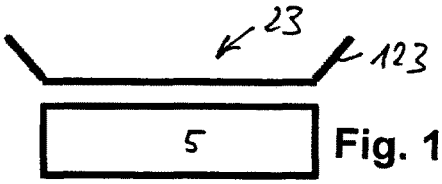

FIGS. 14*a* and 14*b* show in a schematic side view that the attachment patch 23 can also be provided with attachment patch flanks 123 which are formed over the entire peripheral edge or in portions thereof, and one part of which extends away from the substrate (dielectric) 5 positioned therebelow (as in FIG. 14*b*) or one part of which is oriented towards the substrate, as shown in FIG. 14*a*.

Figure 15A:
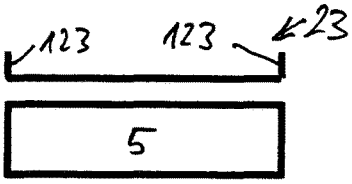
Figure 15B:
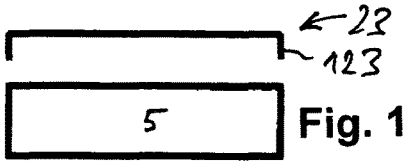

In the variant according to FIGS. 15*a* and 15*b*, said flanks 123 extend perpendicularly to the upper side or perpendicularly away from the patch surface 7' or, in FIG. 15*b*, perpendicularly to and towards the patch surface 7 and the surface of the upper side 5*a* of the dielectric 5.

Figure 16A:
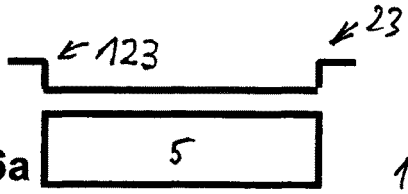
Figure 16B:
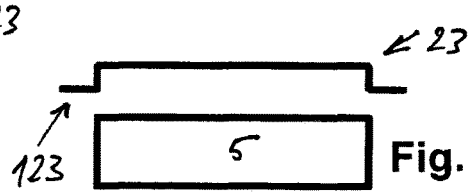

In the embodiment according to FIGS. 16*a* and 16*b*, the attachment patch is provided with an angular edge 123 over the entire periphery or in portions thereof, which edge is provided in the manner of a stepped shoulder extending away from the substrate or dielectric 5 and, in the variant according to FIG. 16*b*, is provided with a step-shaped shoulder extending towards the substrate and the patch surface 7.

FIG. 17 shows in a schematic spatial view that the attachment patch can not only be provided generally with a laterally bent edge portion 12, but also that a plurality of separate or discrete bends 123' can be provided which are for example in the form of a hook, bracket etc., one angular portion 123*a* of which extends away from the patch surface 7' itself while a subsequent further angular portion 123*b* extends, in a plan view of the attachment patch, towards the patch electrode 7 so as to overlap therewith, for example parallel thereto.

A schematic spatial view according to FIG. 18*a* and a schematic side view or cross section according to FIG. 18*b* show and describe that a further dielectric 47 can be provided between the attachment patch 23 and the dielectric 5, which preferably consists of ceramic and comprises the patch surface 7 formed on the upper side 5*a* of the dielectric and the annular or frame patch 19 surrounding the patch surface 7', on the upper side of which further dielectric and with spacing from said upper side 47*a*, the attachment patch 23 is arranged and optionally retained.

In other words, the space between the attachment patch 23 and the patch surface 7 therebelow and the annular or frame-shaped patch electrode 19 surrounding the patch surface 7 is filled over the entire height or part of the height with an additional dielectric 47, that is to say a corresponding dielectric layer 47. This intermediate space can also only be filled in portions with a dielectric 47 of this type. The dielectric layer 47 can for example consist of or comprise a film (for example in the form of a film that is adhesive on both sides).

In the embodiment shown, the additional dielectric 47 is, however, only formed on the peripheral edge and in this case is placed on the lower dielectric in the surface portion 5*c*, and is firmly connected to said lower dielectric, for example is bonded thereto or is integrally formed therewith, neither the central patch 7 nor the frame patch 19 being formed in said dielectric. In this case, any modifications can be provided in which the additional dielectric 47 is indeed frame-shaped but overlaps the frame patch 19 and also the central patch 7 at least in part.

Finally, FIGS. 19*a* and 19*b* show a further modification.

FIG. 19*a* shows in schematic cross section that the attachment patch 23 is preferably provided with an edge portion 23*a* over the entire periphery or in portions thereof, via which the attachment patch can optionally be retained opposite the annular or frame patch 19. In this case, the peripheral edge 23*a* is galvanically connected to the annular or frame-shaped patch 19, so that in this case a capacitive coupling is only still provided between the centrally provided patch electrode 7 and the attachment patch 23.

In the variant according to FIG. 19*b*, the connection is effectively reversed with respect to the variant according to FIG. 19*a*. In the embodiment according to FIG. 19*b*, the attachment patch 23 is galvanically connected to the central patch electrode 7.

In the variant shown, in this case the attachment patch is only provided in a partial region of an annular or frame-shaped portion 23*b* which is raised relative to the plane of the central patch 7 and is galvanically connected to the central patch electrode 7 via an angular portion 23*c*, so that there only remains a capacitive coupling between the annular or frame-shaped attachment patch 23 and the annular or frame-shaped patch electrode 19. In this case, the attachment patch 23 can be formed as a continuous metal sheet comprising the base portion provided within the angular shoulder 23*c*, which base portion is connected to the patch electrode A over the entire surface thereof and thus galvanically. Here, as in the embodiment according to FIG. 19*a*, the attachment patch 23 can thus be formed as a punched and folded metal sheet, which in this respect also functions as a support.

The invention claimed is:

1. Patch antenna assembly comprising:

a patch antenna, the patch antenna comprising a dielectric having a length, a width and a height, on the upper side of the dielectric, a patch electrode is provided in a patch electrode surface, on the underside of the dielectric, a ground plane is provided, the patch electrode is galvanically or capacitively supplied with power via at least one feed line, in the longitudinal and width directions, the dielectric is larger than the longitudinal and width extension of the patch electrode surface located on the upper side of the dielectric, the patch electrode surface is provided so as to be surrounded by an annular or frame patch electrode under formation of an annular patch antenna, between the patch electrode surface and the annular or frame patch electrode surrounding the patch electrode surface, a space or gap for galvanic separation is provided, the patch electrode is at least one of designed and powered such that it can generate or receive a left- or right-circularly polarized electromagnetic wave, the annular or frame patch electrode surrounding the patch electrode surface is designed such that it can at least one of transmit and receive oppositely polarized electromagnetic waves, an attachment patch is provided, the attachment patch is arranged opposite the dielectric with spacing from the patch electrode surface and with spacing from the annular or frame patch electrode, in the longitudinal and transverse directions, the attachment patch has an extension such that said attachment patch covers both the patch electrode surface and the annular or frame patch electrode at least in part to provide non-contact capacitive coupling between the patch electrode surface and the annular patch electrode surface, the attachment patch and the active patch electrode forming a plate capacitor through which energy is transferred via the attachment patch between the active patch electrode and the annular patch electrode.

2. Patch antenna assembly according to claim 1, wherein the patch electrode surface and the annular or frame patch electrode are in a common plane.

3. Patch antenna assembly according to claim 1, further comprising a film arranged between the patch electrode surface and the annular or frame patch electrode on one hand and the attachment patch on the other.

4. Patch antenna assembly according to claim 1, wherein, in two opposite corner regions, the patch electrode is provided with a flat edge or bevel, an angular recess made at least in a corner region, an extension projecting diagonally in the corner region or a slot-shaped or rectangular recess which extends diagonally in plan view.

5. Patch antenna assembly according to claim 1, wherein the patch electrode comprises, at a side portion, a portion projecting over at least part of the length thereof, at one or more side portions, an inwardly extending rectangular recess or rectangular elongate slot in an inner region of the patch electrode surface.

6. Patch antenna assembly according to claim 4, wherein a feed-in point of that at least one feed line, in a plan view of the patch electrode based on an axis passing through a center of the patch electrode at a center point, is arranged such that it is turned by 45° relative to a direction vector which extends through said center point and is oriented towards a recess.

7. Patch antenna assembly according to claim 1, wherein the patch electrode surface has a polarization plane, the annular or frame patch electrode has a polarization plane, and at least one feed line comprises first and second feed lines which supply power to the patch electrode, the first and second feed lines being offset by 90°, the first and second feed lines having feed points that are in the region of the polarization planes.

8. Patch antenna assembly according to claim 1, wherein a galvanic through-connection is provided through the dielectric between the ground plane provided on the underside of the dielectric and the attachment patch, and is galvanically separated from the patch electrode, the feed-in point of the through-connection being offset by 90° from a feed-in point of the at least one feed line on the patch electrode in a plan view of the attachment patch based on a center point of the patch electrode or of the attachment patch or of the dielectric.

9. Patch antenna assembly according to claim 1, wherein the patch electrode is configured to transmit or receive left-circularly polarized electromagnetic waves, and the annular or frame patch electrode surrounding the patch electrode is configured to transmit or receive right-circularly polarized waves.

10. Patch antenna assembly according to at least claim 1, wherein the patch electrode has a resonance frequency for receiving SDARS or SIRIUSXM® services and the annular or frame patch electrode, as an antenna, has a resonance frequency for receiving geostationary satellite signals, for receiving GPS satellite signals.

11. Patch antenna assembly according to claim 1, wherein the annular or frame patch electrode has an inner boundary edge which is substantially parallel to an outwardly-pointing boundary edge of the patch electrode.

12. Patch antenna assembly according to claim 1, wherein the annular or frame patch electrode has an outer boundary edge which is rectangular or square or is substantially rectangular or square.

13. Patch antenna assembly according to claim 1, wherein the at least one feed line is galvanically or capacitively connected to the patch electrode.

14. Patch antenna assembly according to claim 1, wherein the at least one feed line comprises two feed lines having feed points which are mutually offset by 90° in a plan view of the patch electrode.

15. Patch antenna assembly according to claim 1, wherein the attachment patch is structured as an electrically conductive layer, as a metal sheet or as an electrically conductive film.

16. Patch antenna assembly according to claim 1, wherein the attachment patch is bonded to the upper side of the dielectric by an adhesive film that is adhesive on both sides so as to overlap with the patch electrode and the annular or frame patch electrode surrounding the patch electrode surface.

17. Patch antenna assembly according to claim 1, wherein the dielectric projects beyond the annular or frame patch electrode in a longitudinal and transverse direction, on each side thereof by at least 10% and less than 50% of the maximum longitudinal or transverse extension length of the annular or frame patch electrode.

18. Patch antenna assembly according to claim 1, wherein the attachment patch overlaps with the upper side of the dielectric in its entirety.

19. Patch antenna assembly according to claim 1, wherein a ground plane counterpoise surface is formed on the underside of the dielectric.

20. Patch antenna assembly according to claim 1, wherein the longitudinal and transverse extension of the attachment patch corresponds at least to the longitudinal and transverse extension of the patch electrode positioned therebelow.

21. Patch antenna assembly according to claim 1, wherein the attachment patch is provided with at least one opening or recess or a recess extending inwards from a peripheral edge thereof.

22. Patch antenna assembly according to claim 1, wherein the attachment patch is circular, square, rectangular or in the shape of a regular polygon in plan view.

23. Patch antenna assembly according to claim 1, wherein the attachment patch has a peripheral edge, attachment patch flanks being disposed over at least a portion of the attachment patch peripheral edge, at least one part of the attachment patch flanks being oriented so as to extend perpendicular to the patch electrode surface or is provided with step-shaped or angular projections, at least one part of which is directed away from the patch electrode or at least one part of which is oriented to extend towards the patch electrode surface.

24. Patch antenna assembly according to claim 1, wherein a further dielectric is provided between the patch electrode and the attachment patch, the further dielectric comprising a plastic or ceramic adhesive film.

25. Patch antenna assembly according to at least claim 1, wherein the attachment patch is galvanically connected to the annular or frame patch electrode, via a side portion provided over the entire periphery or in portions thereof, to provide capacitive coupling only between the attachment patch and the patch electrode.

26. Patch antenna assembly according to claim 1, wherein the attachment patch is galvanically connected to the patch electrode or transitions, from the patch electrode via a stepped shoulder or an obliquely extending flange, into the attachment patch which is offset from the patch electrode, providing a capacitive coupling only between the attachment patch and the annular or frame patch electrode.

27. Patch antenna assembly according to claim 1 wherein the attachment patch comprises a passive patch antenna assembly, wherein the attachment patch and the patch electrode, which is structured to be active, form a plate capacitor through which energy from the patch electrode is transferred without contact to the annular or frame patch electrode.

28. Patch antenna comprising:

a dielectric substrate having an upper side and an underside, a ground plane disposed on the dielectric substrate underside, an active patch electrode comprising a patch electrode surface disposed on the dielectric substrate upper side, the patch electrode being structured to at least one of generate and receive electromagnetic waves circularly polarized in a first direction, an annular patch antenna comprising an annular patch electrode surface disposed on the dielectric substrate upper side and at least in part surrounding the patch electrode surface, a galvanic separation spacing being provided between the annular patch electrode and the patch electrode surface, the annular patch electrode being structured to at least one of generate and receive electromagnetic waves circularly polarized in a second direction opposite the first direction, at least one feed line structured to capactively or galvanically feed the patch electrode, and a passive attachment patch spaced apart from and above each of the patch electrode surface and the annular patch electrode, the passive attachment patch being dimensioned and positioned to at least in part cover both the patch electrode surface and the annular patch electrode surface to provide non-contact capacitive coupling between the patch electrode surface and the annual patch electrode surface, the passive attachment patch and the active patch electrode forming a plate capacitor through which energy is transferred via the passive attachment patch between the active patch electrode and the annular patch electrode.

29. Patch antenna according to claim 28, wherein said passive attachment patch completely covers the galvanic separation spacing between the annular patch electrode and the patch electrode surface.

30. Patch antenna according to claim 28, wherein the passive attachment patch is a single unitary structure.

31. Patch antenna according to claim 28, wherein the passive attachment patch defines a continuous coupling surface opposing both the annular patch electrode and the patch electrode surface, the continuous coupling surface having no gap therein.

32. Patch antenna according to claim 28, wherein said passive attachment patch has a unitary surface that commonly feeds both the annular patch electrode surface and the patch electrode surface by at least partially overlapping both the annular patch electrode surface and the patch electrode surface.

33. Patch antenna assembly according to claim 1, wherein said attachment patch completely covers the space or gap.

34. Patch antenna assembly according to claim 1, wherein the attachment patch is a single unitary structure.

35. Patch antenna assembly according to claim 1, wherein said attachment patch defines an RF coupling surface that continuously overlaps both the patch electrode and the annular or frame patch electrode with no gap therein.

36. Patch antenna assembly according to claim 1, wherein said attachment patch commonly capactively couples both the patch electrode surface and the annular or frame patch electrode by at least partially overlapping both the patch electrode surface and the annular or frame patch electrode.

* * * * *